US007416170B2

(12) United States Patent
Jablonski et al.

(10) Patent No.: US 7,416,170 B2
(45) Date of Patent: Aug. 26, 2008

(54) CARBONATOR WITH REMOTE LIQUID LEVEL SENSOR

(76) Inventors: Thaddeus M. Jablonski, 243 N. Richards Dr., Palatine, IL (US) 60074; Andrew J. Tobler, 2532 Elder La., Franklin Park, IL (US) 60131

( * ) Notice: Subject to any disclaimer, the term of this patent is extended or adjusted under 35 U.S.C. 154(b) by 141 days.

(21) Appl. No.: 11/224,199

(22) Filed: Sep. 12, 2005

(65) Prior Publication Data

US 2006/0060606 A1 Mar. 23, 2006

Related U.S. Application Data

(60) Provisional application No. 60/611,724, filed on Sep. 21, 2004.

(51) Int. Cl.
*B01F 3/04* (2006.01)

(52) U.S. Cl. ..... 261/49; 261/65; 261/DIG. 7; 426/477

(58) Field of Classification Search ..... 261/37, 261/49, 65, DIG. 7; 426/474, 477; 99/323.2; 222/129.1, 146.6
See application file for complete search history.

(56) References Cited

U.S. PATENT DOCUMENTS 843,778 A * 2/1907 Thomas ..... 261/70
3,877,358 A * 4/1975 Karr ..... 99/275
4,105,725 A * 8/1978 Ross ..... 261/122.1
4,745,853 A * 5/1988 Hoover ..... 99/323.1
4,839,107 A * 6/1989 Rudick et al. ..... 261/82
5,190,189 A * 3/1993 Zimmer et al. ..... 222/67
5,732,563 A * 3/1998 Bethuy et al. ..... 62/139
5,855,296 A * 1/1999 McCann et al. ..... 222/61
6,135,433 A * 10/2000 Nurmi ..... 261/128
6,196,418 B1 * 3/2001 McCann et al. ..... 222/61
2005/0269532 A1 * 12/2005 Ross et al. ..... 250/573

* cited by examiner

*Primary Examiner*—Scott Bushey
(74) *Attorney, Agent, or Firm*—Pyle & Piontek, LLC

(57) ABSTRACT

A carbonator for a beverage dispenser is characterized by a carbonator tank that is placed at a generally inaccessible first location in the beverage dispenser. Liquid and $CO_2$ are supplied to the tank to carbonate liquid in the tank and carbonated liquid at an outlet from the tank is delivered to a beverage dispensing valve. To control delivery of liquid to the carbonator tank and thereby the level of liquid in the tank, a liquid level sensor is fluid coupled to an interior of the tank and is placed in the beverage dispenser at a generally accessible second location that is remote from the first location and from the tank. Placement of the liquid level sensor remote from the carbonator tank and at an accessible location facilitates its repair and replacement.

21 Claims, 4 Drawing Sheets

CARBONATOR WITH REMOTE LIQUID LEVEL SENSOR

This application claims benefit of provisional patent application Ser. No. 60/611,724, filed Sep. 21, 2004.

FIELD OF THE INVENTION

The present invention relates generally to beverage dispensers and in particular to carbonators for beverage dispensers.

BACKGROUND OF THE INVENTION

It is known in the beverage dispensing art to use cold plates to provide heat exchange cooling of drinks. The cold plate itself is cooled by a volume of ice placed in contact with it and, in turn, provides for cooling of beverage liquids flowed through circuits or tubes embedded in the cold plate. A cold plate often is used in conjunction with a post-mix beverage dispenser, in which case sources of plain and carbonated water and beverage syrup flavorings are connected to the cold plate to be cooled as they are passed through the cold plate circuits. A carbonated or non-carbonated drink is then produced when the cooled carbonated or plain water and syrup flavoring constituents are subsequently mixed together and dispensed from a post mix valve.

To provide carbonated water for beverages, a carbonator tank serves as a source of carbonated water and usually is located within the beverage dispenser housing for producing carbonated water through mixture of plain water and carbon dioxide gas. Associated with the carbonator tank are a carbonator pump for delivering potable plain water into the tank and a source of $CO_2$ gas for introduction into the tank for mixture with the potable water in the tank to provide carbonated water, all in a manner well-known in the art. To maintain sufficient water in the carbonator tank for proper carbonation and to meet demands for carbonated water in the serving of beverages, a liquid level sensor customarily is located inside of the tank for sensing the level of water in the tank and for controlling operation of the carbonator pump to deliver water to the tank, as required, to maintain an adequate level of water in the tank. To ensure that the carbonator tank does not become internally overpressurized, a self-actuating pressure relief safety valve is provided on the tank to automatically vent pressure from the tank upon occurrence of an overpressure condition.

A problem with beverage dispensers that use carbonators concerns placement of the carbonator within the dispenser. Locating the carbonator to the exterior of a dispenser is known, but ambient warming of the carbonator and its contents then becomes a problem in terms of dispenser performance and increased ice usage, since the cold plate is then required to chill carbonated water that is warmer than would be the case if the carbonator were located within the dispenser. It therefore is more common and desirable to locate the carbonator in the interior of the beverage dispenser housing, advantageously in a location where heat exchange cooling of the carbonator tank occurs to chill the carbonated water. However, a difficulty that arises is in choosing the particular location for the carbonator, since the liquid level sensor inside of the carbonator tank and the pressure relief safety valve on the tank are serviceable parts that can and do malfunction and require periodic replacement. If the carbonator is placed in a relatively inaccessible location within the dispenser housing, should the liquid level sensor and/or pressure relief safety valve fail or require periodic replacement or maintenance, considerable disassembly of the beverage dispenser, at considerable cost, can be required to access and service the carbonator for repair or replacement of its components. Unfortunately, as ice/beverage dispensers evolve to offer more and more features and performance advantages to users, the space available inside of dispenser housings for convenient and accessible mounting of carbonators has become ever more scarce, often leaving no choice but to mount the carbonator within the dispenser housing at a location that makes it relatively inaccessible and difficult to reach for service or repair of its liquid level sensor and pressure relief valve.

Accordingly, it would be very desirable to have the serviceable parts of a carbonator positioned at a relatively easily accessible location within a beverage dispenser housing, even though the carbonator tank itself may of necessity be positioned at a relatively inaccessible location.

OBJECT OF THE INVENTION

A primary object of the present invention is to provide a carbonator for mounting within a beverage dispenser housing, wherein its carbonator tank can be placed at a relatively inaccessible first location within the dispenser housing while its serviceable components are positioned at a placed accessible second location within the dispenser housing.

SUMMARY OF THE INVENTION

In accordance with the present invention, a carbonator comprises a carbonator tank having a liquid inlet, a carbonating gas inlet and a carbonated liquid outlet; liquid level sensing means located to the exterior of and remote from the carbonator tank; and means for fluid coupling the liquid level sensing means to an interior of the tank for sensing the level of liquid in the tank.

In a preferred embodiment, the carbonator also includes pressure relief means located remote from the carbonator tank and means for fluid coupling the pressure relief means to interior of the tank for relieving overpressure in the tank. The means for fluid coupling the pressure relief means may include the means for fluid coupling the liquid level sensing means to the tank interior, and the carbonator can advantageously have first fluid conduit means having an inlet remote from the tank for fluid coupling to a source of liquid and an outlet fluid coupled to the tank liquid inlet; second fluid conduit means having an inlet remote from the tank for fluid coupling to a source of carbonating gas and an outlet fluid coupled to the tank carbonating gas inlet; and third fluid conduit means having an inlet coupled to the tank carbonated liquid outlet and an outlet remote from the tank for fluid coupling to a point of use of carbonated liquid. In addition, the carbonator can include means responsive to the liquid level sensing means sensing less than a predetermined level of liquid in the carbonator tank for delivering liquid to the tank liquid inlet. The means responsive may comprise pump means fluid coupled between a supply of liquid and the tank liquid inlet, and control means coupled to the liquid level sensing means and to the pump means for operating the pump means to deliver liquid to the tank liquid inlet in responsive to a sensed level of liquid in the tank being less than the predetermined level.

The invention also contemplates a beverage dispensing apparatus that embodies such a carbonator. In this case, the beverage dispensing apparatus comprises a housing; a beverage dispensing valve carried by the housing; a carbonator including a carbonator tank positioned at a first location in the housing, the tank having a liquid inlet, a carbonating gas inlet and a carbonated liquid outlet; liquid level sensing means positioned at a second location in the housing remote from both the first location and from the carbonator tank; means for fluid coupling the liquid level sensing means to an interior of the tank for sensing the level of liquid in the tank; means responsive to the liquid level sensing means sensing less than a predetermined level of liquid in the tank for delivering liquid to the tank liquid inlet; and means for fluid coupling the tank carbonated liquid outlet to the beverage valve to deliver carbonated liquid to the valve.

In a preferred embodiment, the beverage dispensing apparatus includes pressure relief means positioned at a third location in the housing remote from both the first location and from the carbonator tank; and means for fluid coupling the pressure relief means to the tank interior for relieving overpressure in the tank. In addition, the beverage dispensing apparatus may further include first fluid conduit means having an inlet at a fourth location in the housing remote from the first location and from the carbonator tank for fluid coupling to a source of liquid and an outlet fluid coupled to the tank liquid inlet; second fluid conduit means having an inlet at a fifth location in the housing remote from the first location and from the tank for fluid coupling to a source of carbonating gas and an outlet fluid coupled to the tank carbonating gas inlet; and third fluid conduit means having an inlet fluid coupled to the tank carbonated liquid outlet and an outlet at a sixth location in the housing remote from the first location and from the carbonator tank, the outlet for fluid coupling to the beverage dispensing valve. The second, third, fourth, fifth and sixth locations may be toward a front of the housing while the first location is toward a rear of the housing.

The invention also contemplates a method of operating a carbonator, which comprises the steps of placing a carbonator tank of the carbonator at a first location; delivering liquid to a liquid inlet to the carbonator tank; delivering carbonating gas to a carbonating gas inlet to the carbonator tank to carbonate liquid in the tank; providing carbonated liquid from an outlet from the carbonator tank to a point of use; placing a liquid level sensor at a second location remote from both the first location and from the carbonator tank; sensing the level of liquid in the tank by fluid coupling the liquid level sensor to an interior of the carbonator tank; and controlling operation of the liquid delivering step in accordance with the sensing step to maintain at least a predetermined level of liquid in the tank.

In a preferred embodiment of the method of operating the carbonator, included are the steps of placing a pressure relief valve at a third location remote from both the first location and from the carbonator tank; and fluid coupling the pressure relief valve to an interior of the tank to relieve an overpressure condition in the tank. The liquid delivering step may comprise fluid coupling a source of liquid to an inlet to a first conduit leading to the liquid inlet to the carbonator tank, wherein the inlet to the first conduit is at a fourth location remote from the first location and from the tank; the carbonating gas delivering step may comprises fluid coupling a source of carbonating gas to an inlet to a second conduit leading to the carbonating gas inlet to the tank, wherein the inlet to the second conduit is at a fifth location remote from the first location and from the tank; and the providing carbonated liquid step may comprise fluid coupling a third conduit to the outlet from the tank, wherein the third conduit has an outlet at a sixth location remote from the first location and from the tank.

The invention also contemplates a method of operating a beverage dispenser embodying such a carbonator and having a housing and a beverage dispensing valve carried by the housing. The method comprises the steps of placing a carbonator tank of a carbonator at a first location in the housing; delivering liquid to a liquid inlet to the tank; delivering carbonating gas to a carbonating gas inlet to the tank to carbonate liquid in the tank; providing carbonated liquid from an outlet from the tank to the beverage dispensing valve; placing a liquid level sensor at a second location in the housing remote from the first location and from the tank; sensing the level of liquid in the tank by fluid coupling the liquid level sensor to an interior of the tank; and controlling operation of the liquid delivering step in accordance with the sensing step to maintain at least a predetermined level of liquid in the tank.

In a preferred practice of the method of operating the beverage dispenser, included are the steps of placing a pressure relief valve at a third location remote from the first location and from the carbonator tank; and fluid coupling the pressure relief valve to an interior of the tank to relieve an overpressure condition in the tank. In addition, the liquid delivering step comprises fluid coupling a source of liquid to an inlet to a first conduit leading to the liquid inlet to the carbonator tank, wherein the inlet to the first conduit is at a fourth location remote from the first location and from the tank; the carbonating gas delivering step comprises fluid coupling a source of carbonating gas to an inlet to a second conduit leading to the carbonating gas inlet to the tank, wherein the inlet to the second conduit is at a fifth location remote from the first location and from the tank; and the providing carbonated liquid step comprises fluid coupling a third conduit to the outlet from the tank, wherein the third conduit has an outlet at a sixth location remote from the first location and from the tank. The first location may be toward a rear of the housing and the second, third, fourth, fifth and sixth locations may be toward a front of the housing.

The foregoing and other advantages and features of the invention will become apparent upon a consideration of the following detailed description, when taken in conjunction with the accompanying drawings.

DETAILED DESCRIPTION

Figure 1:
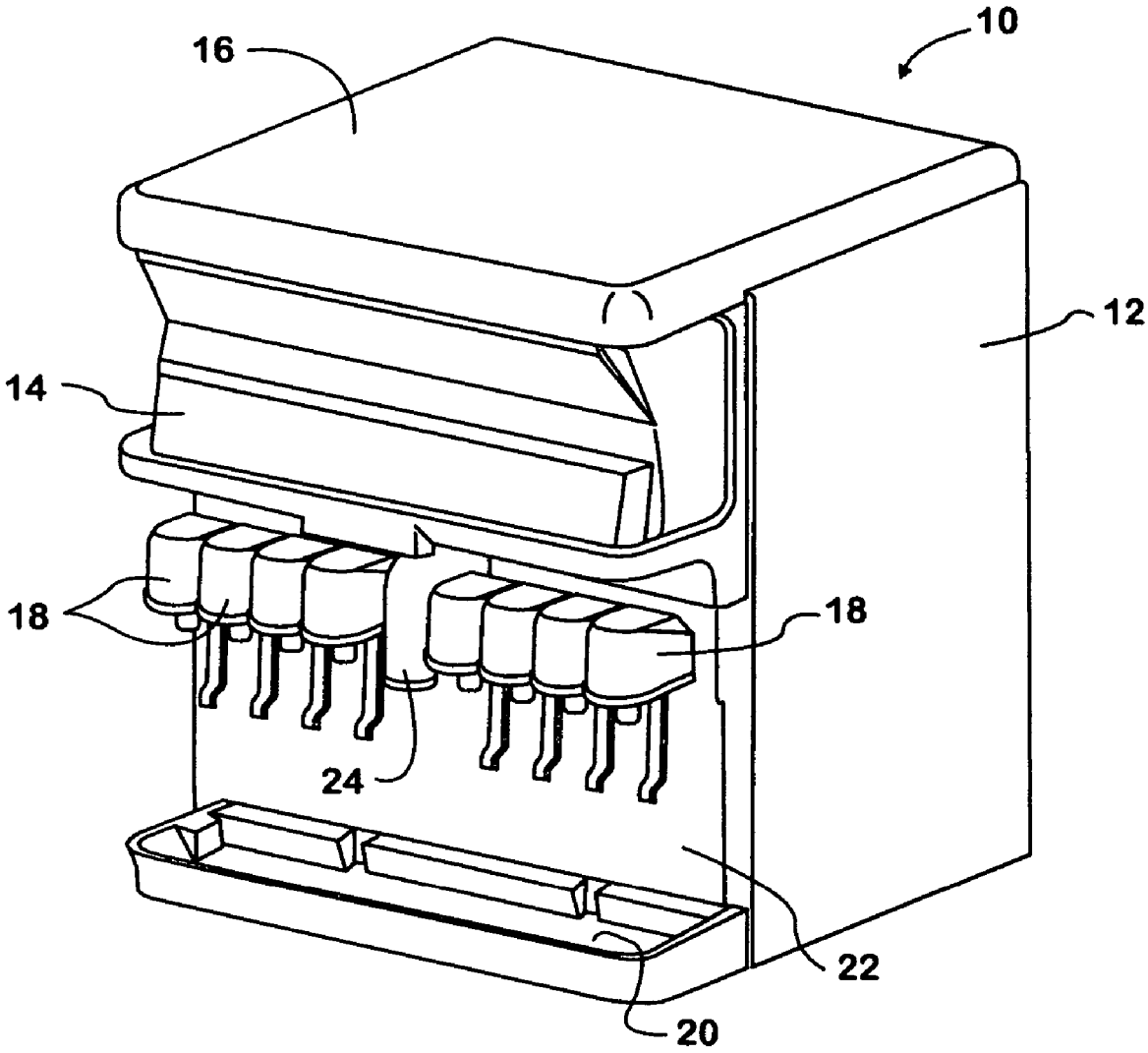
FIG. 1 shows a combination ice and beverage dispenser of a type with which the teachings of the present invention may advantageously be used.

The present invention may advantageously be incorporated into a combined ice and beverage dispensing machine of a general type as seen in FIG. 1 and indicated generally at 10. As is customary, the dispenser includes an outer housing 12, a merchandising cover 14 and a removable ice bin cover 16. A plurality of beverage dispensing valves 18 is secured to a front surface of the dispenser above a drip tray 20 and adjacent a splash panel 22. An ice dispensing chute 24 is secured to the front surface of the dispenser centrally of the valves 18 and above the drip tray 20.

Figure 2:
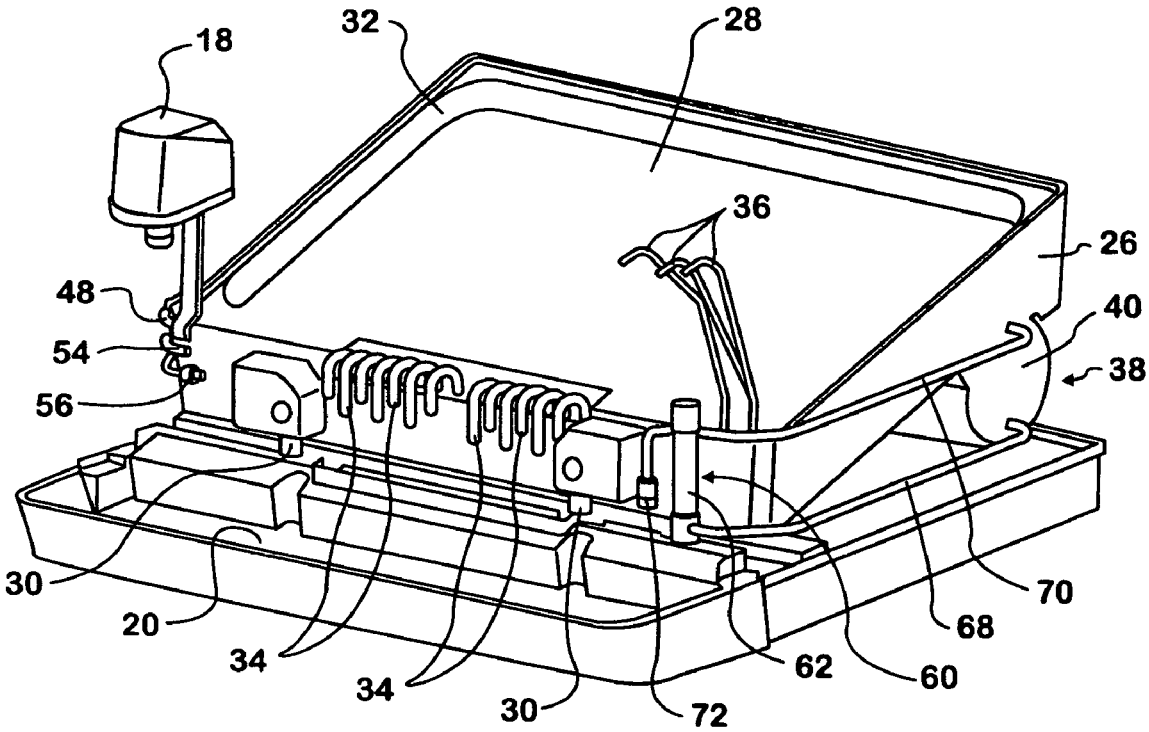
FIG. 2 shows positioning a liquid level sensor and pressure relief valve of a carbonator at a relatively accessible location toward the front of the dispenser while a carbonator tank of the carbonator is positioned at a relatively inaccessible location toward the rear of the dispenser housing and under a cold plate.

As seen in FIG. 2, a cold plate 26 is placed within and toward a lower end of the ice/beverage dispenser housing 12. Although not shown, it is understood that an ice retaining bin or hopper is contained within an upper portion of the housing above the cold plate and that the bin has a forward ice outlet opening through which ice to be dispensed exits the bin for flow into, through and out of the ice dispensing chute 24 into a cup positioned below the chute, as well as a lower ice outlet opening through which ice falls onto and into heat exchange contact with a generally rectangular upper surface 28 of the cold plate 26. The cold plate is positioned at an angle within the dispenser 10, such that its upper surface slopes downward in a direction from the rear toward the front of the dispenser to drain ice melt water from the surface to and through cold plate drains 30. The cold plate surface 28 is defined within an upstanding perimeter edge 32 of the cold plate and a cover (not shown) would be secured to the cold plate along the perimeter edge to enclose the cold plate and define above it a cold plate compartment that resides beneath the ice retaining bin and forms a protected ice retaining space above the cold plate heat exchange top surface 28. The cover, as is conventional, would be provided with an upper opening to accommodate passage of ice from the ice retaining bin lower opening into the ice retaining space and onto the heat exchange top surface of the cold plate. The cold plate includes a plurality of beverage fluid inlet lines 34 and outlet lines 36.

Figure 3:
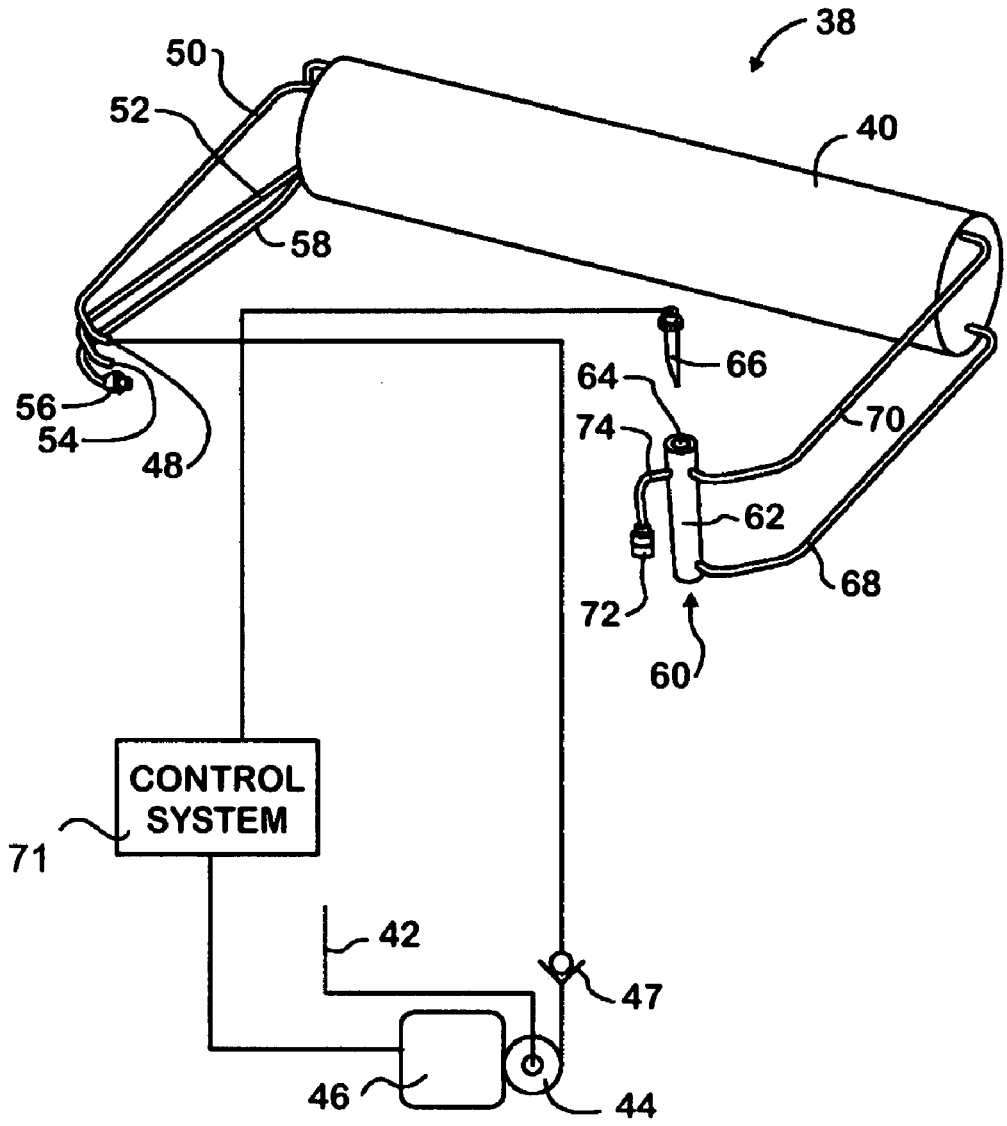
FIG. 3 shows one possible arrangement of the carbonator tank and components.

With reference to FIGS. 2 and 3, so that carbonated beverages may be served from at least some of the post-mix beverage valves 18 of the ice/beverage dispenser 10, the dispenser includes a carbonator, indicated generally at 38. The carbonator includes a generally cylindrical carbonator tank 40 that is placed within the dispenser housing 12. Because space within the housing is limited, it is not always possible to place the carbonator at a location providing convenient access to the carbonator for service and repair and, as shown, the carbonator tank 40 is mounted below a rearward end of the cold plate 26 toward a rearward end of the housing, with contact between the tank and cold plate providing heat exchange cooling of the tank and its carbonated water contents. As so located within the dispenser 10, the carbonator tank is relatively inaccessible, with access to it requiring considerable disassembly of the ice/beverage dispenser. In addition, for thermal efficiency and to inhibit "sweating" of dispenser components, various spaces in the interior of the dispenser 10, including around the carbonator tank 40 and cold plate 26, are customarily insulated by foamed in place insulating material, which further complicates access to the carbonator tank.

The carbonator 38 produces carbonated water in the carbonator tank 40 in a manner well understood in the art, wherein water and $CO_2$ gas are introduced under pressure into and mixed in intimate contact within the tank. As is conventional, the carbonator tank has a water inlet for fluid connection to a source of pressurized potable water, a $CO_2$ gas inlet for fluid connection to a source of pressurized $CO_2$ gas, a carbonated water outlet for fluid connection to one or more of the beverage valves 18, a liquid level sensor for detecting the level of water in the tank and for controlling delivery of potable water into the tank through the water inlet as a function of the withdrawal of carbonated water from the tank through the carbonated water outlet, and a pressure safety relief valve. However, uniike conventional carbonators where the liquid level sensor is contained within the carbonator tank, where the pressure relief safety valve is mounted on the tank and where the connections to the potable water inlet, to the $CO_2$ inlet and to the carbonated water outlet are made right at the tank itself, in the carbonator of the invention the liquid level sensor, pressure relief safety valve, potable water inlet, $CO_2$ inlet and carbonated water outlet connection points are fluid coupled to but remote from the carbonator tank. This unique feature of the carbonator 38 enables the carbonator tank 40 to be located within the beverage dispenser housing 12 at a location that is generally inaccessible, such as at the location shown under and at the rearward end of the cold plate 26, with the liquid level sensor, pressure relief safety valve, potable water inlet, $CO_2$ gas inlet and carbonated water outlet connection points then being remotely located from the tank at accessible locations within the dispenser housing, such for example as directly behind the easily removable splash panel 22. The arrangement advantageously enables the carbonator tank 40, which by itself does not require maintenance or service, to be located in an out of the way and generally inaccessible area of the dispenser, while other components and water connection points of the carbonator 38, that normally must periodically be accessed for service, for repair and/or for connection and disconnection of water lines, are brought to an accessible location in the dispenser.

Figure 4:
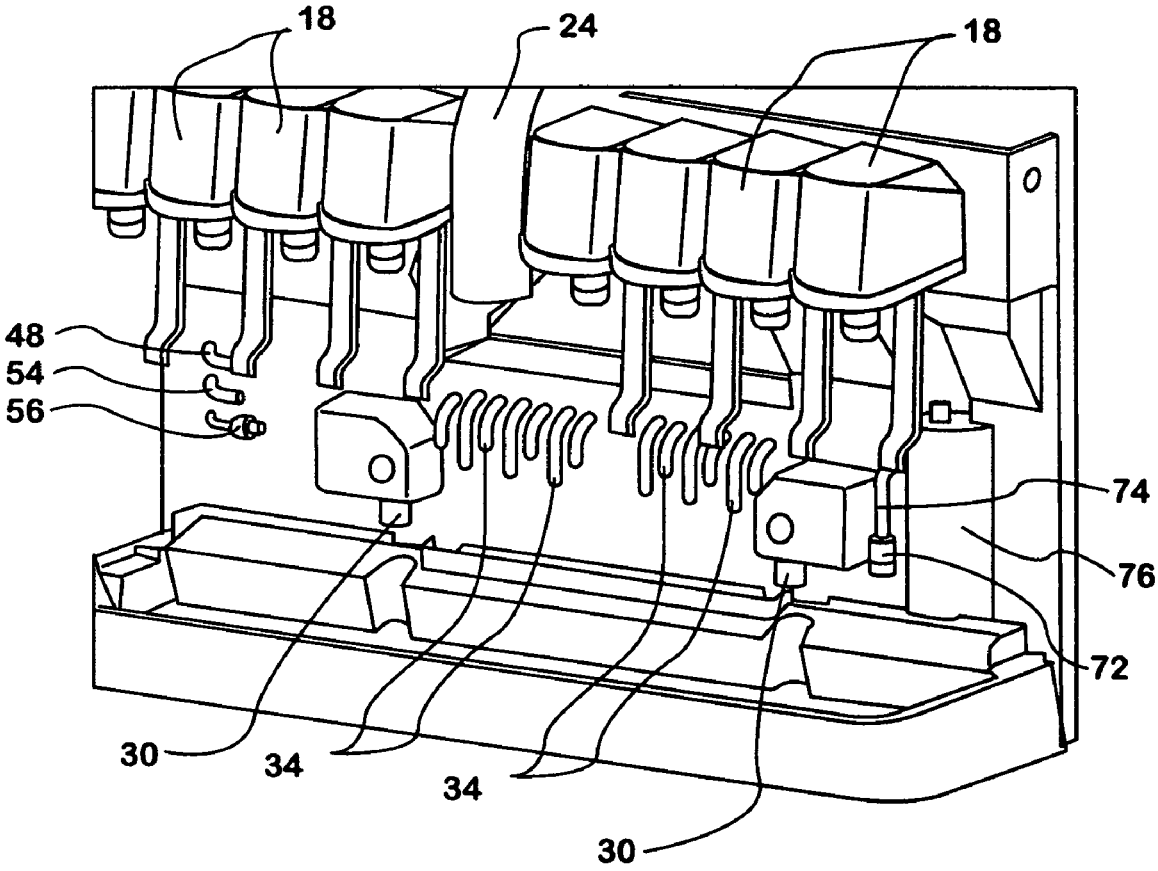
FIG. 4 shows the liquid level sensor and pressure relief valve located toward the front of the dispenser and their relationship to other components of the dispenser.

With particular reference to FIGS. 2-4, potable water from a water supply system is delivered through a line 42 to an inlet to a carbonator pump 44 driven by a motor 46. An outlet from the carbonator pump connects through a pump outlet double check valve 47 to an inlet 48 to a potable water inlet pipe 50 that leads to a water inlet to the carbonator tank 40. The inlet 48 to the pipe 50 is accessibly located at the front of the dispenser 10 just behind the splash panel 22, and while a single check valve would prevent the known hazard of backflow of $CO_2$ or carbonated water into copper pipes of the water supply system, use of a double check valve 47 provides a greater measure of safety, since each of the two check valves is a backup for the other. The carbonator tank 40 also has a carbonated water outlet leading through a carbonated water outlet pipe 52 to an outlet 54 from the pipe that is also accessibly located at the front of the dispenser 10, just behind the splash panel 22, with which carbonated water outlet 54 fluid connections can be made for providing carbonated water to a selected one or more of the beverage valves 18. The carbonator tank 40 receives $CO_2$ gas through a check valve 56 at an inlet to a tube 58 leading to a $CO_2$ inlet to the carbonator tank 40, which check valve also is accessibly located at the front of the dispenser 10, behind the splash panel 22, for convenient connection to a source of pressurized $CO_2$ gas.

The carbonator 38 has a liquid level sensor, indicated generally at 60, for sensing the level of water in the carbonator tank 40 and for controlling operation of the motor 46 for the carbonator pump 44 to deliver potable water into the carbonator tank through the water inlet tube 50 as a function of the withdrawal of carbonated water from the tank through the carbonated water outlet tube 52. In accordance with the invention, instead of being conventionally located within the interior of the relatively inaccessible carbonator tank 40, the liquid level sensor 60 is instead accessibly located at the front of the dispenser 10 behind the splash panel 22. The liquid level sensor includes a column or vertical cylinder having a longitudinal passage 64 that is open at its upper end to receive a liquid level sensing probe 66 and closed at its lower end. A tube 68 fluid connects a lower end of the carbonator tank 40 with the lower end of the cylinder passage 64 and a tube 70 fluid connects an upper end of the tank with the upper end of the cylinder passage. With the probe 66 extended into the cylinder passage 64 in fluid tight connection with the upper end of the passage, the tube 68 connects water in the carbonator tank 40 to the lower end of the cylinder passage, such that the level of water in the cylinder passage is in accord with the level of water in the carbonator tank, with the tube 70 accommodating movement of gas between the upper end of the cylinder passage and the carbonator tank in response to changes in the level of water in the cylinder passage. The probe 66 may be of plastics material and include, for example, a pair of stainless steel rods, lower ends of which are spaced apart and at a level in the passage representative of a desired level of water in the carbonator tank. The stainless steel rods are electrically connected to a control system 71, which is electrically coupled to and controls energization of the carbonator pump motor 46 to operate the carbonator pump 44 and deliver water into the carbonator tank. The arrangement is such that when the level of water in the liquid level sensor cylinder passage 64 is at or above the lower ends of the stainless steel rods, which is indicative of there being sufficient water in the carbonator tank, an electrical connection is established between the rods and sensed by the control system 71, in response to which the control system maintains the pump motor 46 off. However, when the level of water in the cylinder passage falls below and out of contact with the lower ends of the stainless steel rods, which is indicative of a need for water in the carbonator tank, the electrical connection between the rods is interrupted and the control system then energizes the carbonator motor 46 to operate the carbonator pump 44 and deliver water to the carbonator tank, until the level of water in the cylinder passage again reaches and contacts the lower ends of the stainless steel rods. As seen in FIG. 4, the liquid level sensor 60, accessibly located at the front of the beverage dispenser 10 behind the splash panel 22, may be enclosed by a protective shroud 76.

The carbonator 38 additionally includes a self actuating pressure relief safety valve 72 for automatically opening and relieving pressure in the carbonator tank 40, should the pressure in the tank exceed a selected value. The pressure relief valve, instead of being conventionally mounted on the relatively inaccessible carbonator tank 40, is also accessibly located at the front of the dispenser 10 behind the splash plate 22, whereat it connects by a pipe 74 to the cylinder passage 64, generally in the area of connection of the pipe 70 to the passage.

The liquid level sensing probe 66, pressure relief safety valve 72 and check valve 56 are parts of the carbonator 38 and can and do require periodic repair or replacement. Because of placement of these components at the front of the dispenser 10, just behind the splash panel 22, instead of in and at the relatively inaccessible carbonator tank 40, access to these components may conveniently be had for service or repair. In addition, by virtue of also locating at the front of the dispenser 10 the water and $CO_2$ inlets to the carbonator tank 40 and the carbonated water outlet from the tank, fluid connections with and disconnections from these inlets and outlet can readily be made by simply removing the splash panel.

It is to be appreciated that while the carbonator tank has been described as being located toward the rear of the dispenser housing 12 beneath a rearward end of the cold plate 26, the tank could be located elsewhere, it being understood that the teachings of the invention contemplate locating serviceable parts of a carbonator for easy access, irrespective of where the carbonator tank itself is located.

While embodiments of the invention have been described in detail, various modifications and other embodiments thereof can be devised by one skilled in the art without departing from the spirit and scope of the invention, as defined in the appended claims.

What is claimed is:

1. A carbonator, comprising:

a carbonator tank having a liquid inlet for delivery of liquid into said tank, a carbonating gas inlet for delivery of carbonating gas into said tank to carbonate within said tank liquid delivered into said tank, and a carbonated liquid outlet for flow of carbonated liquid from said tank;

liquid level sensing means to the exterior of and located remote from said carbonator tank; and means for fluid coupling said liquid level sensing means to said tank for sensing the level of liquid in said tank.

2. A carbonator as in claim 1, further including:

pressure relief valve means to the exterior of and located remote from said carbonator tank; and means for fluid coupling said pressure relief valve means to said tank, said pressure relief valve means opening to relieve pressure in said tank solely in response to the pressure being at least equal to a selected pressure.

3. A carbonator as in claim 2, wherein said means for fluid coupling said pressure relief valve means to said tank includes said means for fluid coupling said liquid level sensing means to said tank.

4. A carbonator as in claim 1, further including:

first fluid conduit means having an inlet remote from said carbonator tank for fluid coupling to a source of liquid and an outlet fluid coupled to said tank liquid inlet;

second fluid conduit means having an inlet remote from said carbonator tank for fluid coupling to a source of carbonating gas and an outlet fluid coupled to said tank carbonating gas inlet; and third fluid conduit means having an inlet coupled to said tank carbonated liquid outlet and an outlet remote from said carbonator tank for fluid coupling to a point of use of carbonated liquid.

5. A carbonator as in claim 1, further including:

means for being coupled to a supply of liquid and responsive to said liquid level sensing means sensing less than a predetermined level of liquid in said carbonator tank for delivering liquid from the supply to said tank liquid inlet.

6. A beverage dispensing apparatus, comprising:

a housing;

a beverage dispensing valve carried by said housing;

a carbonator including a carbonator tank positioned at a first location in said housing, said tank having a liquid inlet for delivery of liquid into said tank, a carbonating gas inlet for delivery of carbonating gas into said tank to carbonate within said tank liquid delivered into said tank, and a carbonated liquid outlet for flow of carbonated liquid from said tank;

liquid level sensing means positioned at a second location in said housing located remote from said first location and from said carbonator tank;

means for fluid coupling said liquid level sensing means to said tank for sensing the level of liquid in said tank;

means responsive to said liquid level sensing means sensing less than a predetermined level of liquid in said tank for delivering liquid from a supply of liquid to said tank liquid inlet; and means for fluid coupling said tank carbonated liquid outlet to said beverage valve to deliver carbonated liquid to said valve.

7. A beverage dispensing apparatus as in claim 6, further including:

pressure relief valve means positioned at a third location in said housing remote from said first location and from said carbonator tank; and means for fluid coupling said pressure relief valve means to said tank, said pressure relief valve means opening to relieve pressure in said tank solely in response to the pressure being at least equal to a selected pressure.

8. A beverage dispensing apparatus as in claim 7, wherein said means for fluid coupling said pressure relief valve means to said tank includes said means for fluid coupling said liquid level sensing means to said tank.

9. A beverage dispensing system as in claim 7, further including:

first fluid conduit means having an inlet at a fourth location in said housing remote from said first location and from said carbonator tank for fluid coupling to a source of liquid and having an outlet fluid coupled to said tank liquid inlet;

second fluid conduit means having an inlet at a fifth location in said housing remote from said first location and from said tank for fluid coupling to a source of carbonating gas and having an outlet fluid coupled to said tank carbonating gas inlet; and third fluid conduit means having an inlet fluid coupled to said tank carbonated liquid outlet and an outlet at a sixth location in said housing remote from said first location and from said carbonator tank for fluid coupling to said beverage dispensing valve.

10. A beverage dispensing apparatus as in claim 9, wherein said second, third, fourth, fifth and sixth locations are toward a front of said housing and said first location is toward a rear of said housing.

11. A method of operating a carbonator, comprising the steps of:

placing a carbonator tank of the carbonator at a first location;

delivering liquid to a liquid inlet to the carbonator tank;

delivering carbonating gas to a carbonating gas inlet to the carbonator tank to carbonate within the tank liquid delivered into the tank;

providing carbonated liquid from an outlet from the carbonator tank to a point of use;

placing a liquid level sensor at a second location located remote from the first location and from the carbonator tank;

sensing the level of liquid in the carbonator tank by fluid coupling the liquid level sensor to the carbonator tank; and controlling operation of said delivering step to deliver liquid to the liquid inlet to the carbonator tank in response to said sensing step sensing less than a predetermined level of liquid in the carbonator tank.

12. A method as in claim 11, including the steps of:

placing a normally closed pressure relief valve at a third location remote from the first location and from the carbonator tank; and fluid coupling the pressure relief valve to an interior of the tank, the pressure relief valve opening to relieve pressure in the tank solely in response to the pressure being at least equal to a selected value.

13. A method as in claim 12, wherein said step of fluid coupling the pressure relief valve to the carbonator tank interior utilizes said step of fluid coupling the liquid level sensor to the tank.

14. A method as in claim 11, wherein said liquid delivering step comprises fluid coupling a source of liquid to an inlet to a first conduit leading to the liquid inlet to the carbonator tank, wherein the inlet to the first conduit is at a third location remote from the first location and from the tank; said carbonating gas delivering step comprises fluid coupling a source of carbonating gas to an inlet to a second conduit leading to the carbonating gas inlet to the tank, wherein the inlet to the second conduit is at a fourth location remote from the first location and from the tank; and wherein said providing carbonated liquid step comprises fluid coupling a third conduit to the outlet from the tank, wherein the third conduit has an outlet at a fifth location remote from the first location and from the tank.

15. A method of operating a beverage dispenser having a housing and a beverage dispensing valve carried by the housing, comprising the steps of:

placing a carbonator tank of a carbonator at a first location in the housing;

delivering liquid to a liquid inlet to the tank;

delivering carbonating gas to a carbonating gas inlet to the tank to carbonate within the tank liquid delivered into the tank;

providing carbonated liquid from an outlet from the tank to the beverage dispensing valve;

placing a liquid level sensor at a second location in the housing located remote from the first location and from the tank;

sensing the level of liquid in the tank by fluid coupling the liquid level sensor to the tank; and controlling operation of said delivering step to deliver liquid to the liquid inlet to the tank in to said sensing step sensing less than a predetermined level of liquid in the tank.

16. A method as in claim 15, including the steps of:

placing a normally closed pressure relief valve at a third location remote from the first location and from the carbonator tank; and fluid coupling the pressure relief valve to an interior of the tank, the pressure relief valve opening to relieve pressure in the tank solely in response to the pressure being at least equal to a selected value.

17. A method as in claim 16, wherein said step of fluid coupling the pressure relief valve to the carbonator tank interior utilizes said step of fluid coupling the liquid level sensor to the tank.

18. A method as in claim 16, wherein said liquid delivering step comprises fluid coupling a source of liquid to an inlet to a first conduit leading to the liquid inlet to the carbonator tank, wherein the inlet to the first conduit is at a fourth location remote from the first location and from the tank; said carbonating gas delivering step comprises fluid coupling a source of carbonating gas to an inlet to a second conduit leading to the carbonating gas inlet to the tank, wherein the inlet to the second conduit is at a fifth location remote from the first location and from the tank; and wherein said providing carbonated liquid step comprises fluid coupling an inlet to a third conduit to the outlet from the tank, wherein the third conduit has an outlet at a sixth location remote from the first location and from the tank and fluid coupled to the beverage dispensing valve.

19. A method as in claim 15, wherein said first location is toward a rear of the housing and said second location is toward a front of the housing.

20. A method as in claim 16, wherein said first location is toward a rear of the housing and said second and third locations are toward a front of the housing.

21. A method as in claim 18, wherein said first location is toward a rear of the housing and said second, third, fourth, fifth and sixth locations are toward a front of the housing.

* * * * *

UNITED STATES PATENT AND TRADEMARK OFFICE

CERTIFICATE OF CORRECTION

PATENT NO. : 7,416,170 B2
APPLICATION NO. : 11/224199
DATED : August 26, 2008
INVENTOR(S) : Thaddeus M. Jablonski and Andrew J. Tobler It is certified that error appears in the above-identified patent and that said Letters Patent is hereby corrected as shown below:

Column 10, line 25, after "in" insert --response--

Signed and Sealed this

Eleventh Day of November, 2008

JON W. DUDAS
*Director of the United States Patent and Trademark Office*